US006478168B1

(12) United States Patent
McNamee

(10) Patent No.: US 6,478,168 B1
(45) Date of Patent: Nov. 12, 2002

(54) BELT HANGER

(76) Inventor: Dena C. McNamee, 189 Arbor Springs Plantation Dr., Newnan, GA (US) 30265

( * ) Notice: Subject to any disclaimer, the term of this patent is extended or adjusted under 35 U.S.C. 154(b) by 0 days.

(21) Appl. No.: 09/753,739

(22) Filed: Jan. 3, 2001

(51) Int. Cl.[7] ..... A47F 7/19
(52) U.S. Cl. ..... 211/85.3; 211/115; 211/119
(58) Field of Search ..... 211/85.3, 119, 211/115; D6/317

(56) References Cited

U.S. PATENT DOCUMENTS

| | | | | | |
|---|---|---|---|---|---|
| 303,177 | A | | 8/1884 | Miller | |
| 2,459,417 | A | | 1/1949 | Dodge | 211/89 |
| 2,510,452 | A | * | 6/1950 | Witt | 211/85.3 |
| D190,608 | S | * | 6/1961 | Forrester | 211/119 X |
| D196,469 | S | | 10/1963 | Kennedy | D80/8 |
| 3,872,973 | A | | 3/1975 | Duncan | 211/115 |
| 3,887,079 | A | * | 6/1975 | Crew | 211/119 X |
| 4,628,859 | A | * | 12/1986 | Hines | 118/630 |
| D293,281 | S | * | 12/1987 | White | D8/373 |
| D322,721 | S | * | 12/1991 | Curry | D6/317 |
| 5,328,068 | A | * | 7/1994 | Shannon | 211/113 X |
| 5,437,378 | A | | 8/1995 | Ta | 211/115 |
| D368,166 | S | | 3/1996 | Sacks | D6/315 |
| D369,909 | S | | 5/1996 | Sacks | D6/315 |
| 5,642,817 | A | | 7/1997 | O'Brien | 211/60.1 |
| 5,645,173 | A | | 7/1997 | Taylor et al. | 211/1.56 |
| 5,664,708 | A | | 9/1997 | Sacks | 223/85 |
| D392,098 | S | * | 3/1998 | Finkelman | D3/315 |
| D404,577 | S | | 1/1999 | Schildkraut | D6/315 |
| 5,950,884 | A | * | 9/1999 | Payne | 223/85 |
| D417,556 | S | * | 12/1999 | Schell | D6/315 |

FOREIGN PATENT DOCUMENTS

| | | | | |
|---|---|---|---|---|
| DE | 299 17 393 U1 | * | 4/2000 | A47G/25/74 |
| FR | WO 94/27478 | * | 12/1994 | A47G/25/74 |

OTHER PUBLICATIONS

Advertisement for Key Bracelets by Green Rhino, Inc.
Advertisement for wine glass charms.

* cited by examiner

*Primary Examiner*—Daniel P. Stodola
*Assistant Examiner*—Eric B. Harris
(74) *Attorney, Agent, or Firm*—Russell C. Gache; Sirote & Permutt, P.C.; Kenneth M. Bush

(57) ABSTRACT

A belt hanger preferably comprising a closed ring member having a plurality of clips attached at intervals along the ring member. Each clip is preferably operable to releasably attach one belt. The clips are maintained at spaced intervals such that the belts are not fully overlapped. The belt hanger further comprises a hook member rotatably mounted along the outer periphery of the ring member for engaging a horizontal closet support rod such that the ring member is supported thereby. The rotatable mounting allows the ring member to rotate relative to the stationary hook member secured to the horizontal support rod. Accordingly, the ring member can be stored in a substantially flattened state until a belt is needed, at which time the ring member can be rotated to allow the user to simultaneously view all the belts hanging on the belt rack and remove only the desired belt.

21 Claims, 8 Drawing Sheets

BELT HANGER

FIELD OF THE INVENTION

The present invention relates generally to devices for organizing articles of clothing. More particularly, the present invention is an apparatus for organizing belts.

BACKGROUND OF THE INVENTION

A common clothing accessory is the belt. Most people have more than one belt and many people have numerous belts that differ in size, color, and style. Conveniently storing a significant number of belts can be problematic. Prior art belt holders typically include one or more hooks designed to receive belt buckles thereover, thereby vertically supporting the belts by their buckles. Each hook is typically designed to support several belts such that the "front" belt obscures direct viewing of and access to the "back" belts. This is inconvenient inasmuch as it becomes necessary to push aside the front belts to view the back belts, which frequently results in one or more belts becoming dislodged from the hook and falling to the floor. Further, if a plurality of belts are hung from a single hook, the to user must remove all of the belts in front of the desired belt in order to gain access to the desired belt. This process is inconvenient and time-consuming since all undesired belts must not only be removed from the hook, but replaced on the hook after the desired belt has been removed.

Accordingly, what is needed is an apparatus that overcomes these problems by providing a belt hanger capable of displaying a plurality of belts for simultaneous viewing wherein each belt is directly accessible.

SUMMARY OF THE INVENTION

It is an object of the present invention to provide a belt hanger designed to hold a plurality of belts that allows the user to conveniently select and remove the desired belt from the belt hanger.

It is another object of the present invention to provide a belt hanger designed to display a plurality of belts for simultaneous viewing.

It is another object of the present invention to provide a belt hanger designed to hold a plurality of belts wherein each belt is directly accessible.

It is another object of the present invention to provide a belt hanger cable of substantially two-dimensional storage.

These and other objects of the invention are accomplished with a belt hanger preferably comprising a closed ring member having a plurality of clips attached at intervals along the ring member. Each clip is preferably operable to releasably attach one belt. The clips are maintained at spaced intervals such that the belts are not fully overlapped. The belt hanger further comprises a hook member rotatably mounted along the outer periphery of the ring member for engaging a horizontal closet support rod such that the ring member is supported thereby. The rotatable mounting allows the ring member to rotate relative to the stationary hook member secured to the horizontal support rod. Accordingly, the ring member can be stored in a substantially flattened state until a belt is needed, at which time the ring member can be rotated to allow the user to simultaneously view all the belts hanging on the belt rack and conveniently remove only the desired belt.

Other features and objects and advantages of the present invention will become apparent from a reading of the following description as well as a study of the appended drawings.

BRIEF DESCRIPTION OF THE DRAWINGS

A belt hanger incorporating the features of the invention is depicted in the attached drawings, which form a portion of the disclosure, and wherein.

DESCRIPTION OF THE PREFERRED EMBODIMENTS

Figure 13:
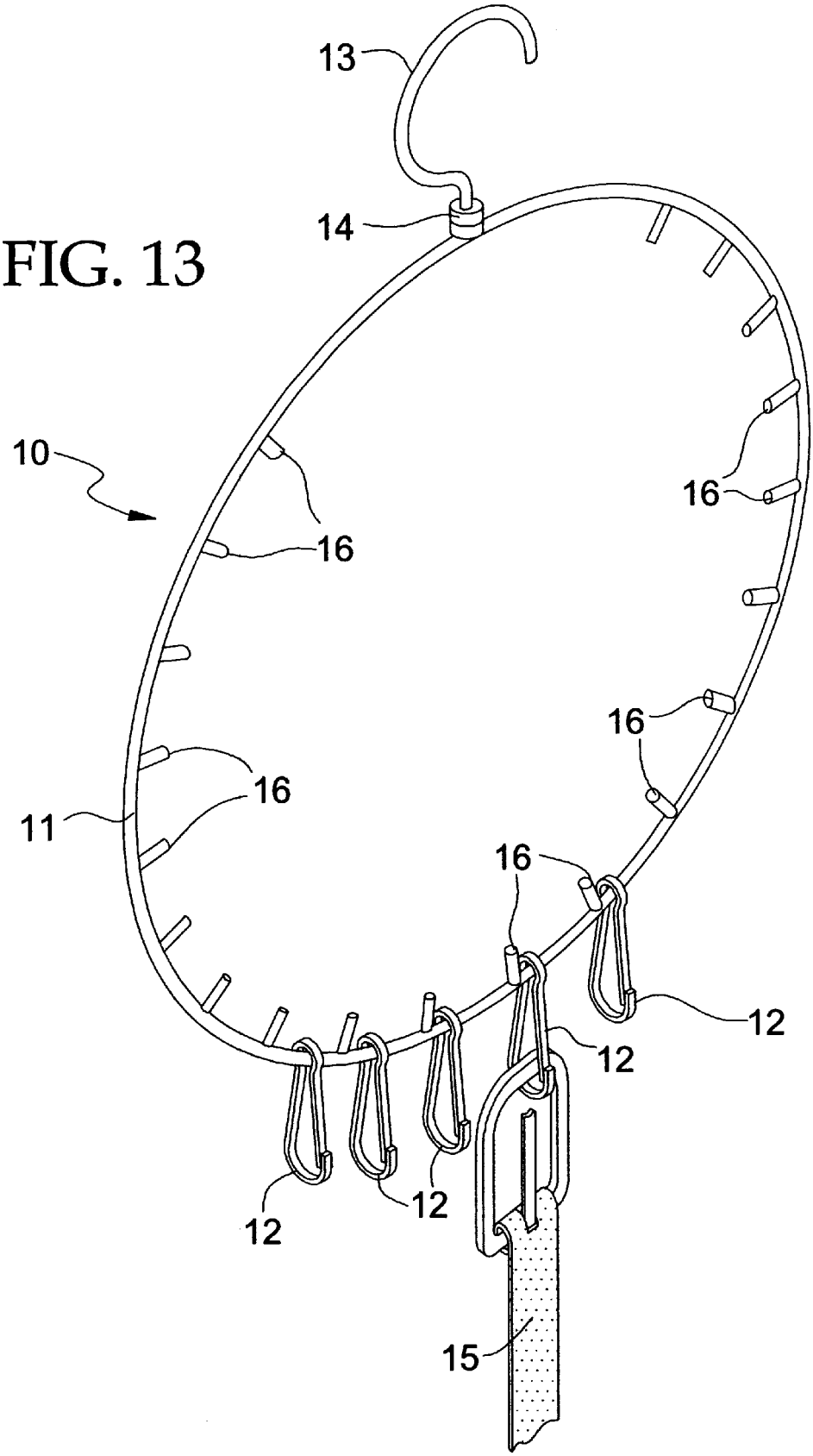
FIG. 13 is a perspective view of another alternate embodiment of the present invention.
Figure 14:
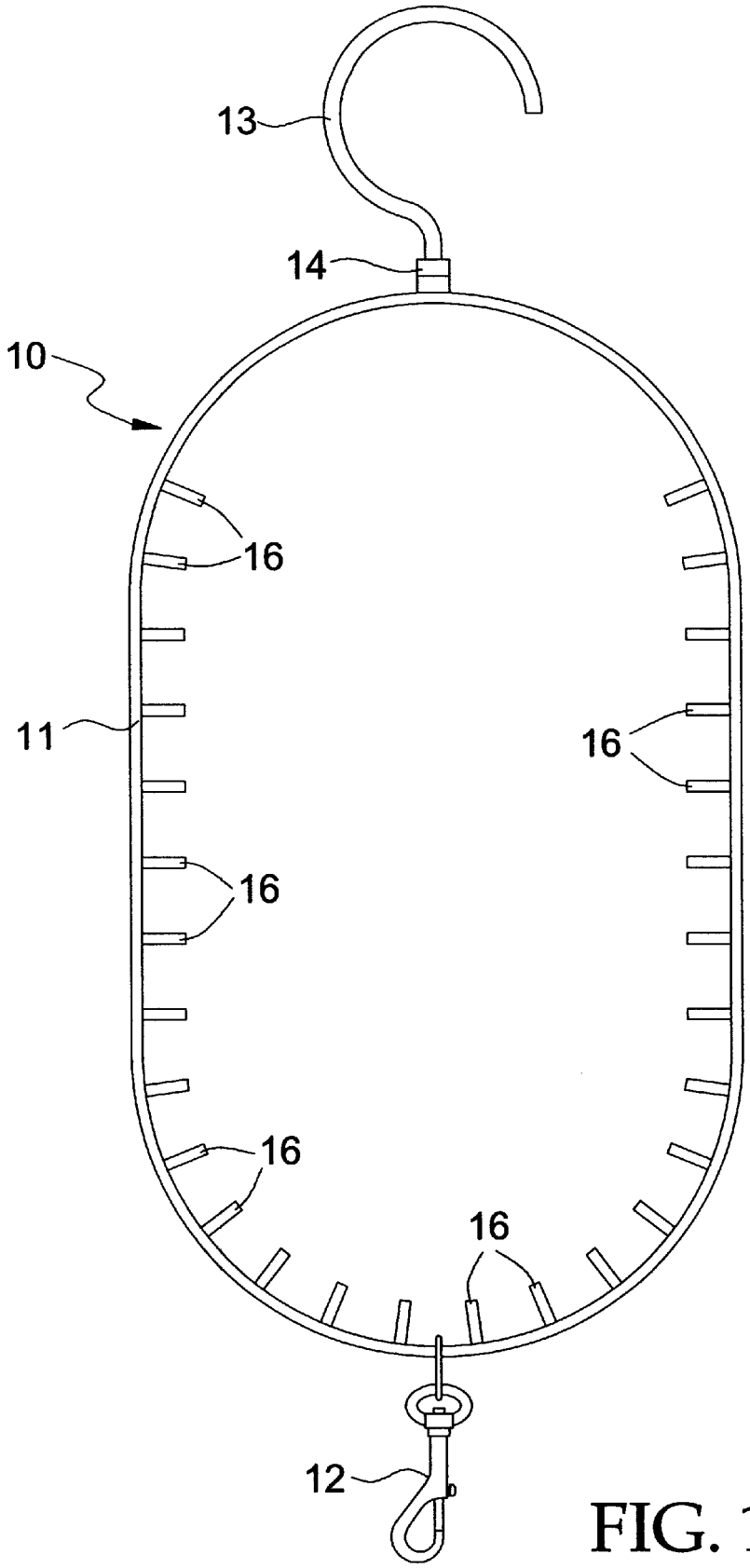
FIG. 14 is a front view of yet another alternate embodiment of the present invention.

Referring to the drawings for a better understanding of the function and structure of the invention, FIGS. 1–14 illustrate the belt hanger 10 of the present invention comprising a ring member 11 having a plurality of holding means 12 attached at intervals along the ring member 11. The ring member 11 is preferably closed, although a partially opened ring structure could be used. The ring member 11 is preferably circular, as shown in FIGS. 1, 2, 7, 8 and 13, but can have other geometric shapes as well, such as an elliptical shape as shown in FIG. 14. However, a critical aspect of the shape of the ring member is that it be convexly shaped so that convenient presentation of objects hung on the invention is maintained. The ring member can be comprised of any appropriate material, such as metal or plastic.

Figure 1:
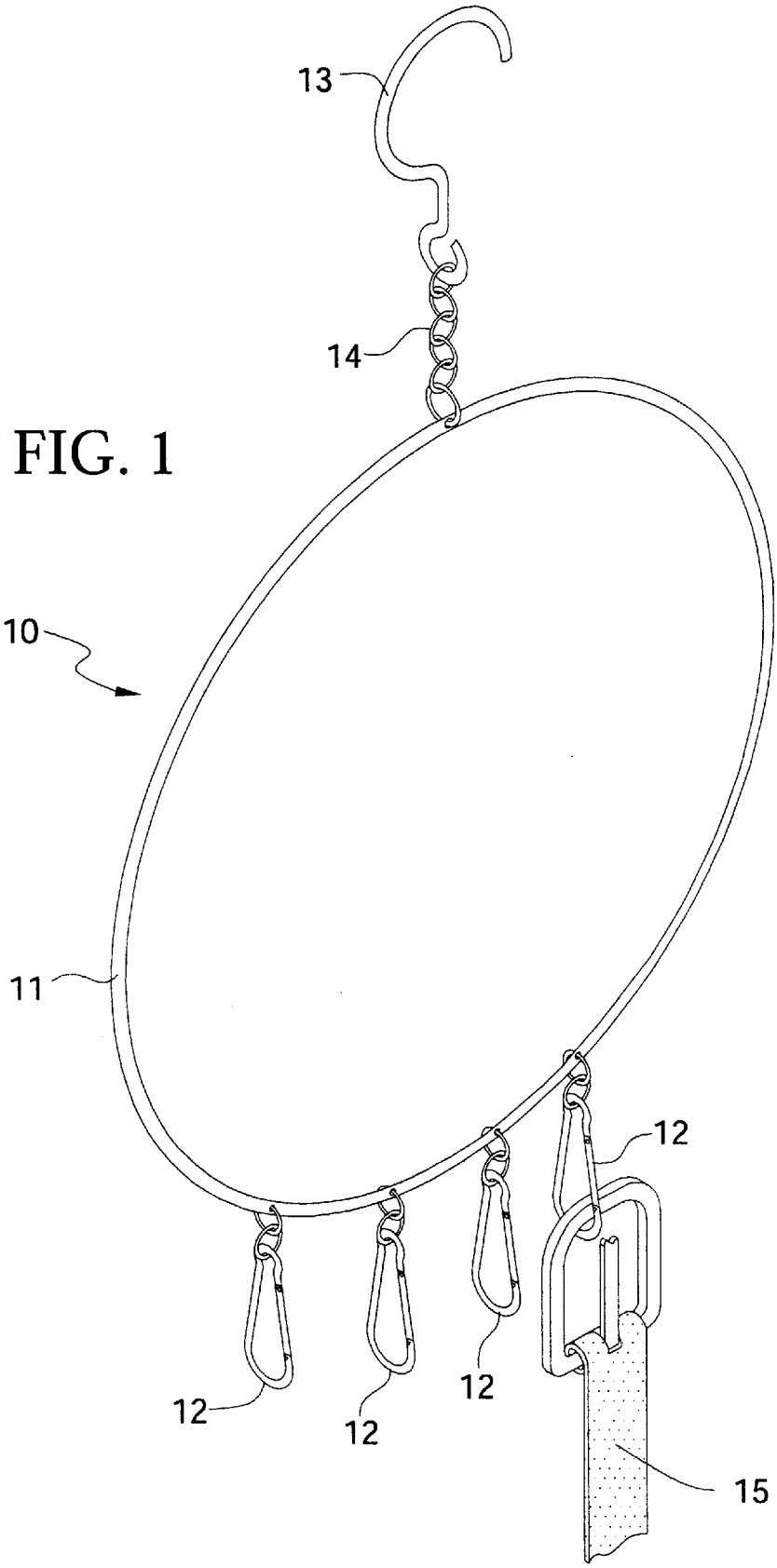
FIG. 1 is a perspective view of the preferred embodiment of the present invention.
Figure 2:
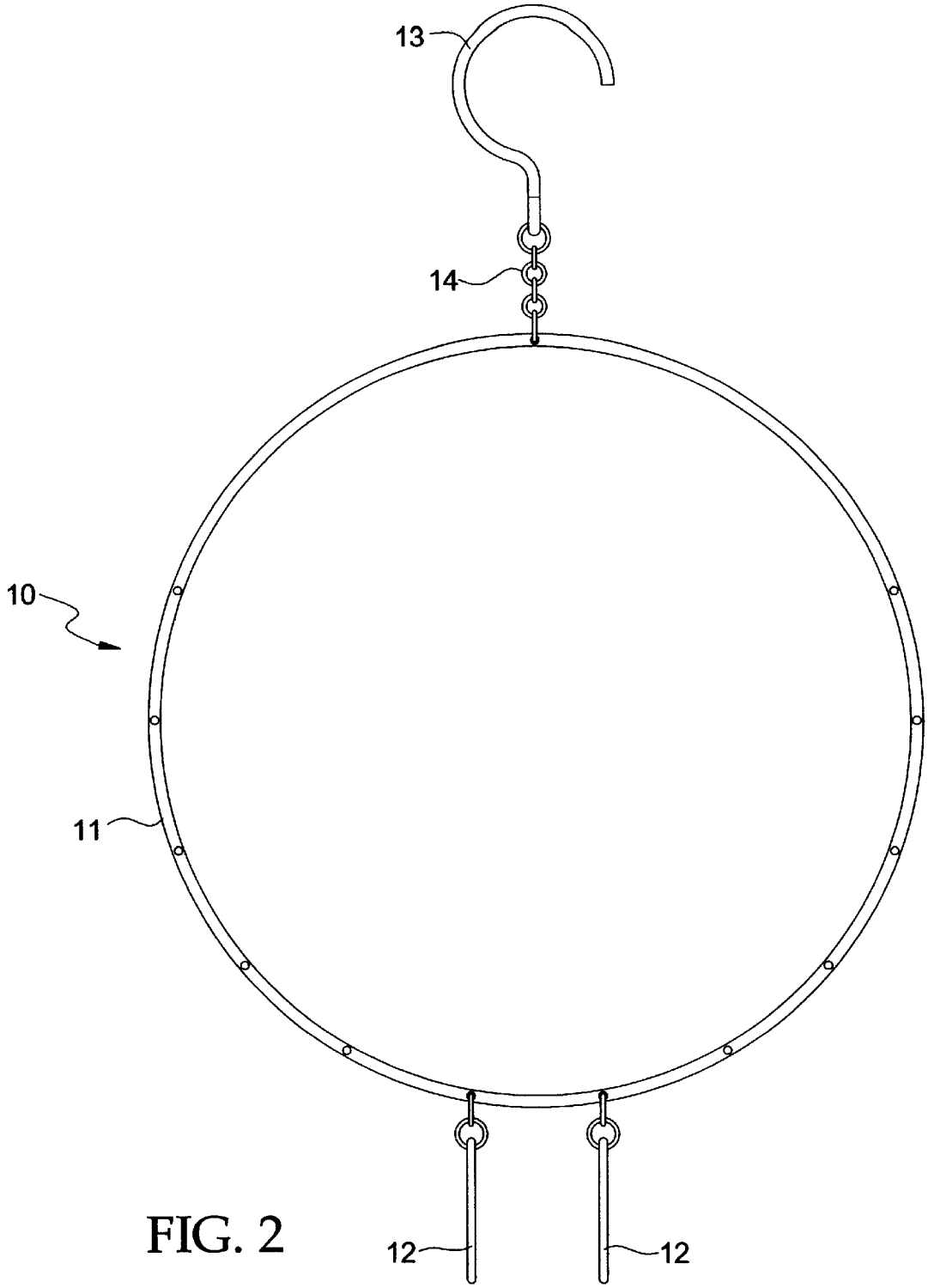
FIG. 2 is a front view of the preferred embodiment of the present invention.
Figure 3:
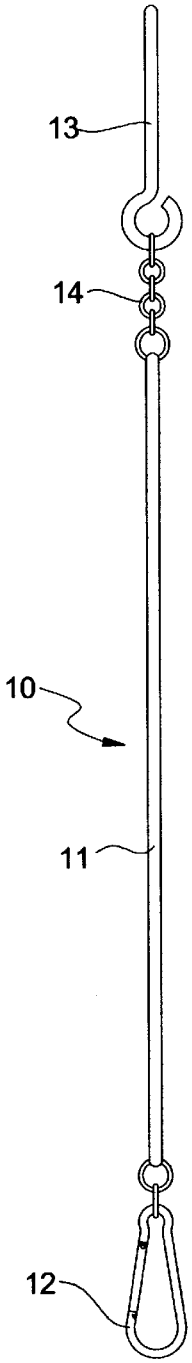
FIG. 3 is a left side view of the invention as shown in FIG. 2.
Figure 4:
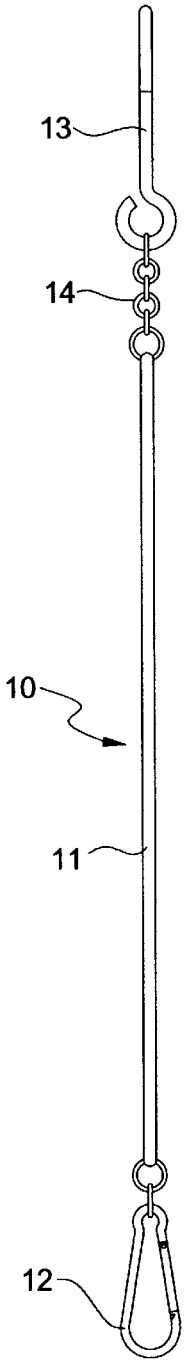
FIG. 4 is a right side view of the invention as shown in FIG. 2.
Figure 5:
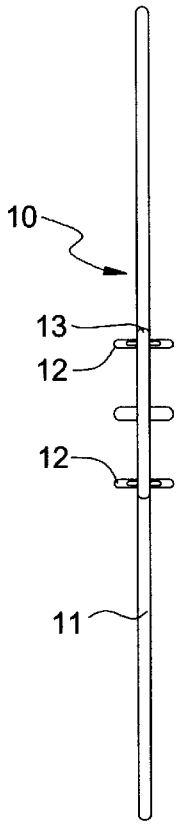
FIG. 5 is a top view of the invention as shown in FIG. 2.
Figure 6:
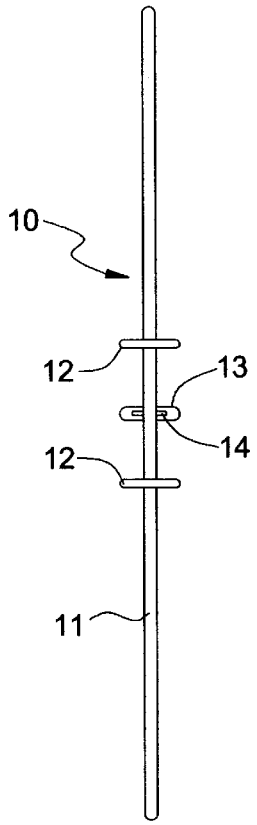
FIG. 6 is a bottom view of the invention as shown in FIG. 2.
Figure 7:
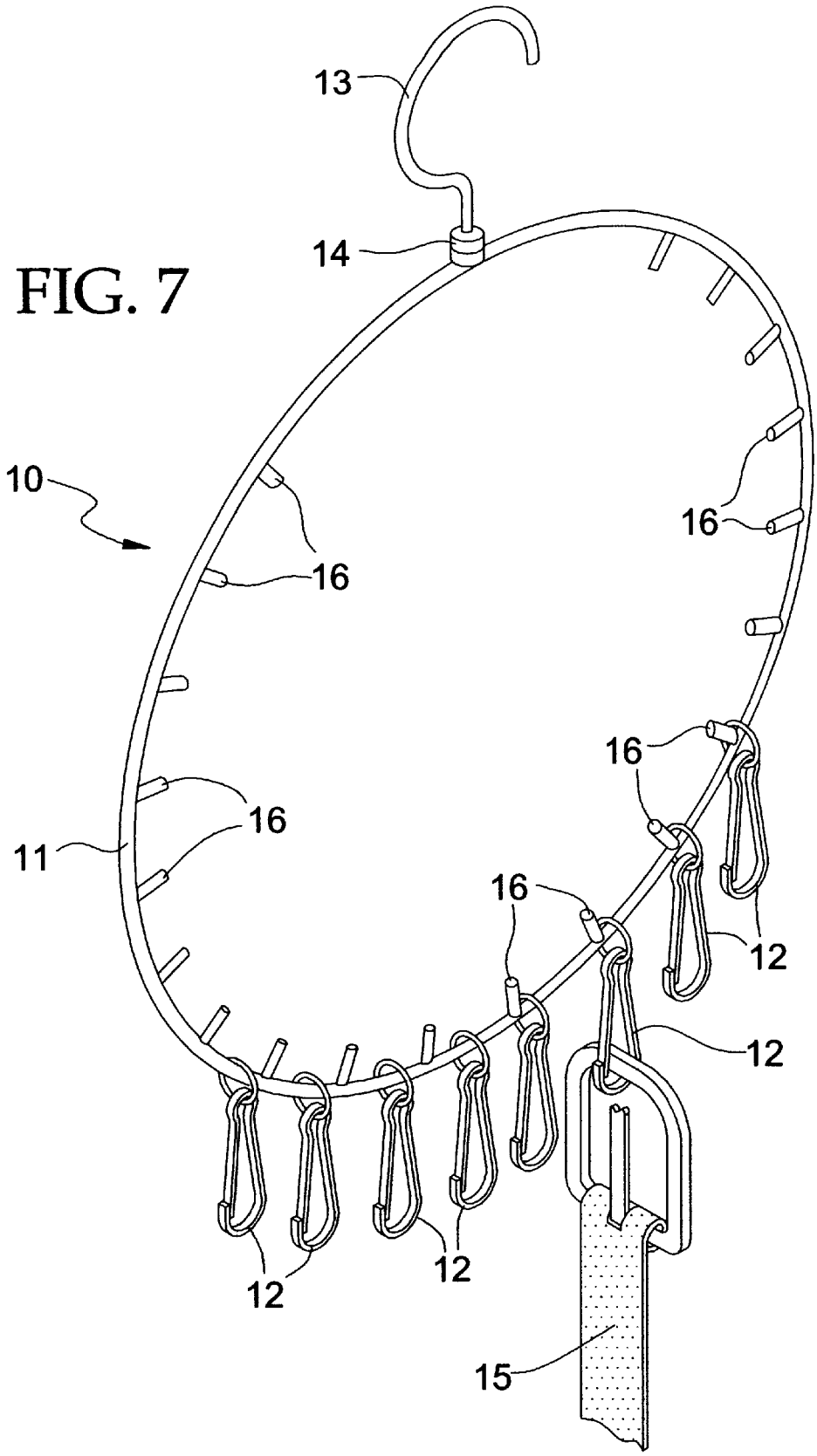
FIG. 7 is a perspective view of an alternate embodiment of the present invention.

The holding means 12 can be any type of standard clip that allows for convenient removal and replacement of a belt. The holding means 12, for example, can be comprised of spring base carabiners (FIG. 1), integral spring clips (FIG. 7), or retractable spring levered leash clips (FIG. 14). The holding means 12 can be attached to the ring member 11 such that the belts are supported substantially in the plane of the ring member 11, as shown in FIGS. 1 and 13, or are substantially perpendicular to the plane of the ring member 11 , as shown in FIG. 7. Each holding means 12 is preferably operable to releasably attach one belt 15, although the holding means can be designed to attach more than one belt if desired. The holding means 12 are maintained at spaced intervals such that the attached belts are not fully overlapped. It will be appreciated that spaced intervals may be created in a variety of manners. As shown in FIG. 1, the preferred embodiment, holding means 12 may be affixed to the ring member 11 through interim links which are affixed to the ring member 11 through a drilled hole as shown. Alternatively, the holding means 12 may be directly affixed to the ring member 11 by having a portion of its structure passing through a similarly drilled hole in the ring member 11. Holes that may be drilled through ring member 11 must obviously be spaced at sufficient intervals to accommodate a necessary spacing such that belts do not overlap. Further, it is envisioned that spaced intervals will extend around the ring member 11 and rise to such a height toward the hook member 13 such that a convenient presentation of belts 15 is achieved.

The belt hanger 10 further comprises a hook member 13 rotatably mounted along the periphery of the ring member 11 for engaging supporting means (not shown), such as a closet support rod, such that the ring member 11 is supported by the supporting means. Obviously, it is foreseen that any type of supporting object in a closet such as a belt clip or wall hook could be used to support the invention. The hook member 13 is mounted to the ring member 11 in such a manner that the hook member 13 cannot move longitudinally along the ring member 11; however, the mounting assembly 14 allows the ring member 11 to rotate relative to the stationary hook member 13 secured to the supporting means. It will be appreciated that various types to mounting assemblies may be introduced to achieve the free rotation of hook member 13 relative to ring member 11. In the preferred embodiment, a multiplicity of links are shown in the mounting assembly 14 to connect the hook member 13 to a ring member 11. However, in the alternate embodiment shown in FIG. 7, mounting assembly 14 can be achieved through a simple rotatable coupling or pintle.

Figure 8:
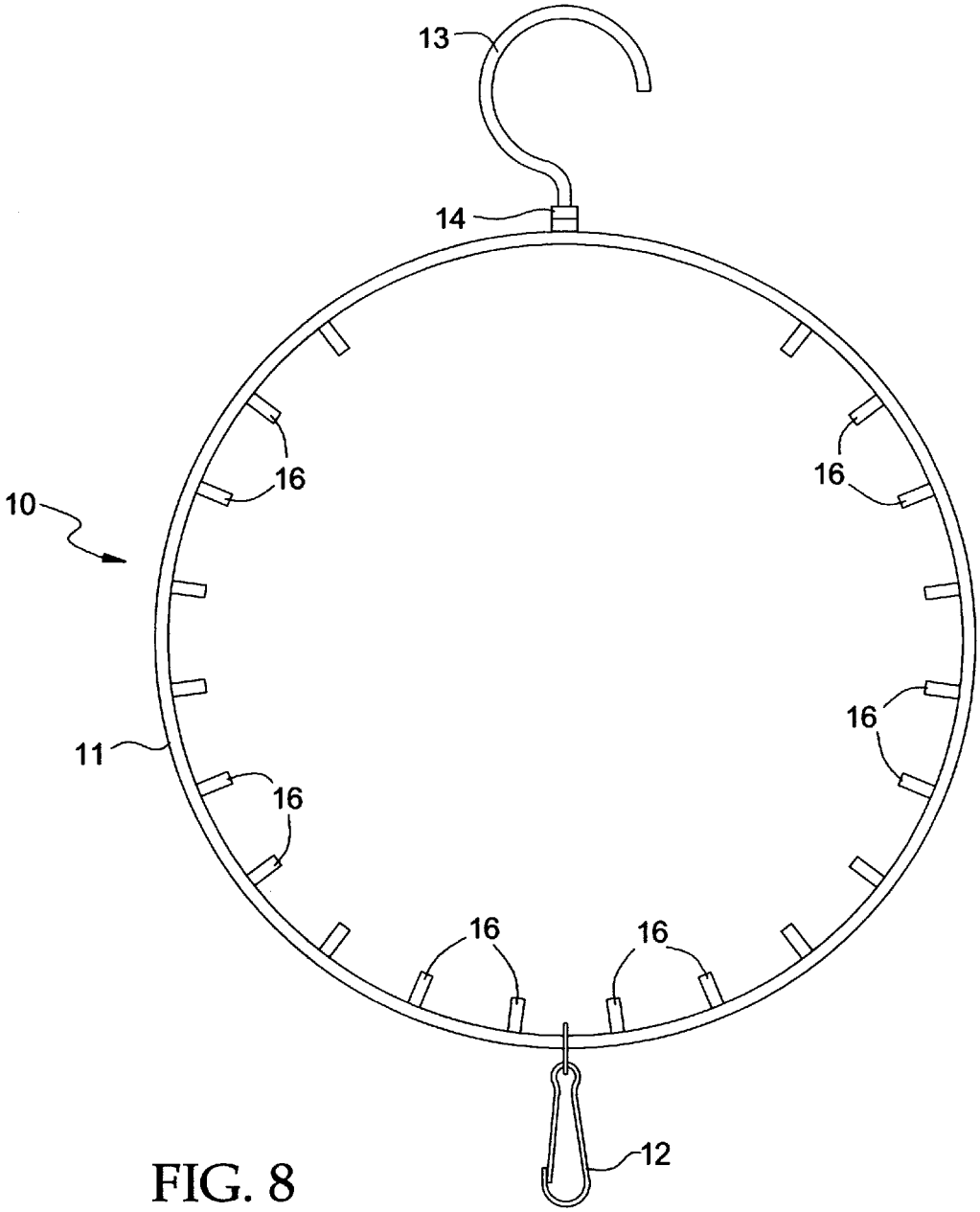
FIG. 8 is a front view of the embodiment of FIG. 7.
Figure 9:
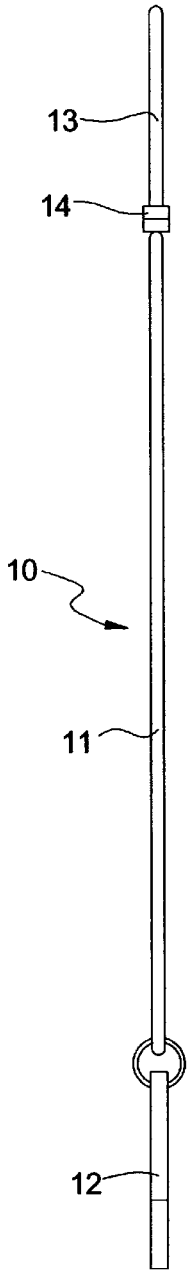
FIG. 9 is a left side view of the embodiment of FIG. 7.
Figure 10:
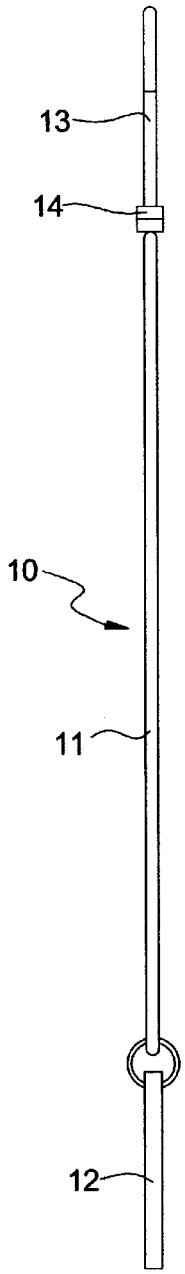
FIG. 10 is a right side view of the embodiment of FIG. 7.
Figure 11:
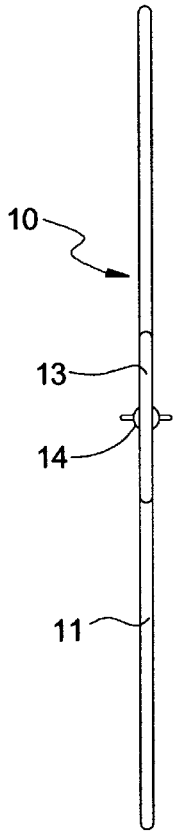
FIG. 11 is a top view of the embodiment of FIG. 7.
Figure 12:
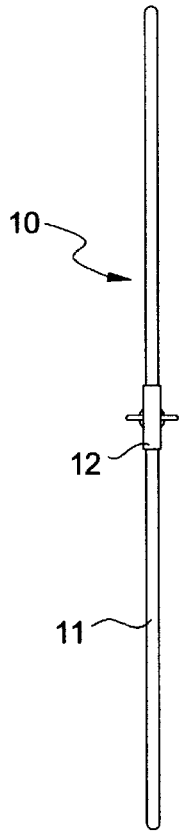
FIG. 12 is a bottom view of the embodiment of FIG. 7.

In an alternate embodiment, the ring member 11 comprises a plurality of projections 16 extending from the periphery of the ring member 11. The projections 16 are preferably located on the inner periphery of the ring member 11 and extend radially toward the center thereof as shown in FIGS. 7, 8 and 13. The holding means 12 are attached to the ring member 11 at intervals between the projections 16. The holding means 12 can pivot about the ring member 11 but are restricted to longitudinal movement between the projections 16. In this alternate embodiment as shown in FIG. 7, the holding means 12 has additional flexibility to move a selected amount between projection 16, which, in some instances, might facilitate the presentation and viewing of belts secured to the ring member 11.

Accordingly, the ring member 11 can be stored in a substantially flattened state until a belt is needed, at which time the ring member 11 can be rotated to allow the user to simultaneously view all the belts hanging on the belt rack 10 and conveniently remove only the desired belt. As seen in FIG. 14, an elliptical shape satisfies the convenient presentation goal while reducing the transverse closet space required to accommodate the invention.

It is to be understood that the forms of the invention shown are preferred embodiments thereof and that various changes and modifications may be made therein without departing from the spirit of the invention or scope as defined in the following claims. For example, the inventor foresees that the invention may be utilized for any type of belt-like object, such as scarfs, decorative bandanas, shawls, wraps, sashes, or even some necklaces.

Having set forth the nature of the present invention, what is claimed is:

1. An apparatus for supporting a plurality of belts, comprising:

a ring member having a plurality of projections extending from the periphery of said ring member, said ring member defined by a center and a fixed length radius extending therefrom, and having interval portions separating said projections from one another;

a hook member mounted along the periphery of said ring member for engaging horizontal supporting means such that said ring member is supported by the horizontal supporting means; and a plurality of holding means attached to ring member on said interval portions such that said holding means are restricted to movement on said interval portions between said projections;

wherein each of said holding means is operable to releasably attach at least one belt.

2. An apparatus according to claim 1, wherein said ring member is circular.

3. An apparat us according to claim 1, wherein said ring member has a shape defined by two non-collocated foci to form an ellipse.

4. An apparatus according to claim 1, wherein said projections extend radially from the inner periphery of said ring member toward the center of said ring member.

5. An apparatus according to claim 1, wherein said hook member is rotatably mounted along the outer periphery of said ring member.

6. An apparatus according to claim 5, wherein said rotatably mounted hook member is fixed along said outer periphery of said ring member.

7. An apparatus according to claim 1, wherein a single holding means is attached to said ring member at each of said intervals.

8. An apparatus for supporting a plurality of belts, comprising:

a closed ring member having a plurality of projections extending radially from the inner periphery of said ring member toward the interior of said ring member, said ring member being defined by a single center point and a fixed radius, said ring member having interval portions separating said projections from one another;

a hook member rotatably mounted along the outer periphery of said ring member for engaging a closet support rod such that said ring member is supported by the support rod; and a plurality of clips attached to said ring member on said intervals portions such that said clips are restricted to movement on said interval portions between said projections;

wherein each of said clips is operable to releasably attach at least one belt.

9. An apparatus according to claim 8, wherein a single clip is attached to said ring member at each of said intervals.

10. A device for conveniently displaying a plurality of belt objects in a closet, comprising:

means for hooking said device onto a closet support rod;

means depending downward from said hooking means for supporting said plurality of belt objects from said device, said support means having a convexly curved outer periphery along its entire outer perimeter, a fixed center, and a radius circumscribing said outer periphery;

means for separating each belt object from one another along said outer periphery to promote individual viewing of each said belt object; and means supported by said outer periphery for detachably holding each belt object from said device.

11. A device as recited in claim 10, wherein said separating means comprises a plurality of fixed projections spaced along said outer periphery, said plurality of projections defining individual sections around said periphery between each projection, each said section having at least one said means for detachably holding each belt-like object.

12. A device as recited in claim 11, wherein said fixed projections are spaced evenly around said periphery.

13. A device as recited in claim 11, wherein said means for detachably holding each belt-like object comprises a clip, said clip slidably retained within a single section around said outer periphery.

14. A device as recited in claim 13, wherein said hooking means is rotatably affixed to said support means at a fixed point along said outer periphery.

15. A device as recited in claim 14, wherein said outer periphery forms a circle.

16. A device as recited in claim 14, wherein said outer periphery forms an oval.

17. A device for conveniently displaying a plurality of belt objects, comprising:

means for hooking said device onto a support;

means depending downward from said hooking means for supporting said belt objects, said support means having a convexly curved outer periphery along its entire outer perimeter; and plurality of means coupled to said support means for detachably holding said plurality of belt objects from said device, wherein said plurality of holding means are attached to said support means at spaced intervals to separate each belt object from one another to promote individual viewing of each belt object.

18. A device as recited in claim 17, wherein each of said plurality of holding means comprises a clip.

19. A device as recited in claim 17, wherein said hooking means is rotatably affixed to said support means at a fixed point along said outer periphery.

20. A device as recited in claim 17, wherein each of said plurality of holding means is directly affixed to said support means such that equal distant space intervals are formed between each said holding means.

21. A device as recited in claim 20, wherein said holding means comprises a spring loaded clip.

* * * * *